United States Patent [19]

Batson

[11] Patent Number: 5,016,784

[45] Date of Patent: May 21, 1991

[54] APPLICATOR FOR HIGHLY REACTIVE MATERIALS

[75] Inventor: Robert E. Batson, Newington, Conn.

[73] Assignee: Dexus Research Inc., Newington, Conn.

[21] Appl. No.: 481,448

[22] Filed: Feb. 15, 1990

[51] Int. Cl.[5] ..... B67D 5/42

[52] U.S. Cl. ..... 222/386; 222/327; 206/384; 53/471

[58] Field of Search ..... 222/327, 386, 386.5; 206/384; 53/467, 471

[56] References Cited

U.S. PATENT DOCUMENTS 3,524,537 8/1970 Winter .
4,109,833 8/1978 Gross ..... 222/386.5
4,247,023 1/1981 Shew ..... 222/386
4,556,156 12/1985 Frutin ..... 222/386.5

*Primary Examiner*—Michael S. Huppert
*Assistant Examiner*—Gregory L. Huson
*Attorney, Agent, or Firm*—Daniel J. Hudak Co.

[57] ABSTRACT

An applicator syringe for containing and dispensing moisture-sensitive or moisture-reactive adhesives comprises a generally sealed barrel containing a plunger having a non-stick polymeric seal and a hydrocarbon grease disposed between the seal and the adhesive contained in the barrel. As the plunger advances in the barrel, a sealing, thin film of the hydrocarbon grease is deposited on the interior walls of the syringe barrel to provide a moisture-impervious seal between the polymeric seal and barrel and to aid in smooth advancement of the plunger in the barrel.

19 Claims, 2 Drawing Sheets

APPLICATOR FOR HIGHLY REACTIVE MATERIALS

FIELD OF THE INVENTION

The present invention relates to packaging and dispensing of moisture-sensitive adhesives and sealants, and more particularly to sealed applicators for containing and dispensing moisture-sensitive or otherwise highly reactive materials which must be protected from moisture contamination or atmospheric environment after packaging as well as prior to and during use.

BACKGROUND

Packaging of adhesives and sealants in syringes is more difficult than in tubes or bottles because of the necessity to provide a dynamic seal between the interior surface of the syringe barrel or tube and the circumferential periphery of the plunger of the syringe forcing the contents from the barrel. This interior peripheral seal must be effective to prevent egress of volatile solvents as well as ingress of atmospheric elements and yet readily permit the plunger to move past the interior wall surfaces of the barrel during the dispensing operation. Failure to have an adequate seal can cause deterioration of the adhesive or sealant properties, premature gelling, and short shelf-life, as well as failure or nonfunctioning of the applicator.

A particularly difficult class of adhesive and sealant materials comprise reactive compositions and in particular moisture-sensitive or reactive compositions. Cyanoacrylate adhesives and sealants, for instance, polymerize spontaneously in the presence of trace amounts of water, whereby setting or hardening occurs within a few seconds after exposure, particularly in small gaps such as might occur between the interior surface of the syringe barrel and the circumferential periphery of the plunger. A prior art container of cyanoacrylic ester adhesive is shown in U.S. Pat. No. 3,524,537. Prior to the present invention, useful plunger-type syringes did not exist for use in dispensing cyanoacrylate adhesives. A major practical problem relates to internal adhesion and binding between the plunger and interior sidewall of the barrel due to some curing of the adhesive. Similarly, other adhesive compositions, such as moisture-cure polyurethanes and silicones, require moisture-free, sealed syringes operative to dispense the adhesive and yet maintain the adhesive contents remaining in the barrel free of moisture and other atmospheric contaminants.

SUMMARY OF THE INVENTION

In accordance with the present invention, a plunger-type dispensing syringe for moisture-sensitive adhesives contains a layer of hydrocarbon grease separating the face of the plunger and the adhesive contents, with the grease layer being adapted to flow radially outward against the interior sidewall surface of the syringe barrel as the plunger advances during the adhesive-dispensing operation. The hydrocarbon grease forms a thin film interface between the outer periphery of the advancing plunger and the barrel interior wall surface to form a moisture-proof, lubricating film barrier behind the plunger as the plunger moves forward. A polymer material seal preferably is secured to the forward face of the plunger to protect the face of the plunger from contact with the adhesive and to facilitate the formation of a thin film of grease on the interior wall surface of the syringe barrel. To prevent the hydrocarbon grease from being dispensed from the barrel along with the last contents of the adhesive, an internal stop means preferably is located inside the barrel approximate to the dispensing nozzle section of the barrel to prevent further forward advancement of the plunger and to accommodate the volume of grease utilized along with minor amounts of undispensed adhesive in the nozzle section. The nozzle is fitted with a removable, air-tight, sealing cap to prevent moisture penetration through the nozzle opening when the syringe is not in use.

DETAILED DESCRIPTION OF THE INVENTION

Figure 1:
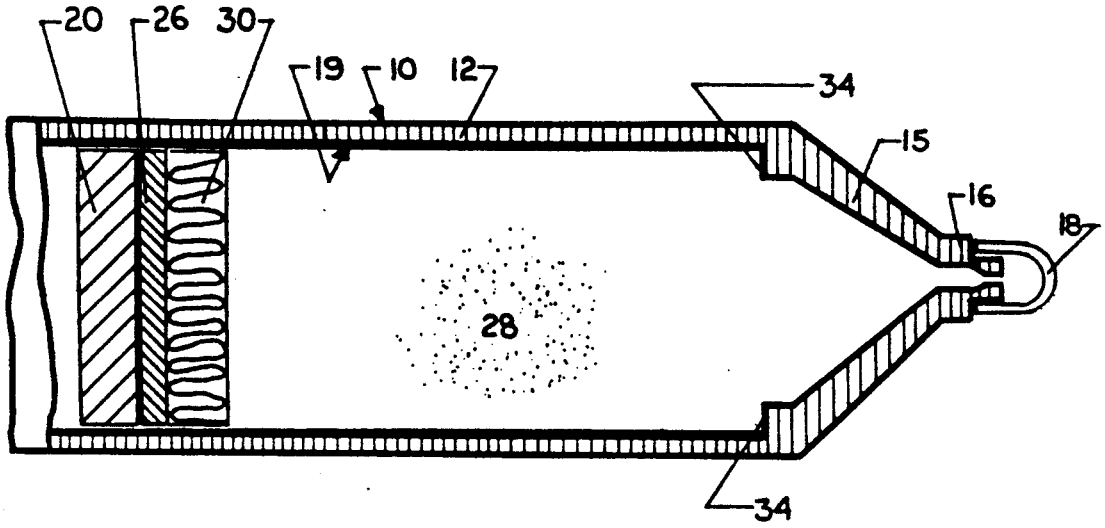
FIG. 1 is a front elevation, sectional view of the adhesive dispensing syringe of the present invention.

Referring now to the drawings wherein like reference characters designate like parts, shown generally is the dispensing syringe 10 of the present invention for dispensing moisture- and air-sensitive adhesives and sealants in accordance with the present invention.

Syringe 10 comprises a container having a cylindrical barrel 12 partially enclosed with a forward nose section 15 containing a dispensing nozzle 16 fitted with a removable sealing cap 18. The barrel 12 is equipped with a plunger 20. The plunger 20 contains a polymeric facing material 26 secured to the internal forward face of the plunger 20. The polymeric seal 26 is approximately the same diameter as the plunger 20 where the circumferential periphery of seal 26 is adapted to slidably engage the internal surface 19 of the barrel 12 as the plunger 20 is advanced forwardly within the cylindrical barrel 12. It is well known in the art that plunger 20 can be advanced by using air pressure or a mechanically operated external piston, such as for industrial applications. If desired, a rearwardly extending stem (not shown) could be attached to the plunger to provide means for manually advancing the plunger, as by a user's thumb, such as for consumer applications.

The cylindrical barrel 12 is made of non-reactive plastic which is essentially inert and non-reactive to the adhesive or sealant 28 contained therein. Preferred plastics are low density or high density polyethylene, polypropylene, poly(monochlorotrifluoroethylene), or similar non-reactive plastic. The cylindrical barrel 12 can be entirely plastic or can be a composite with a cylindrical plastic interior surface 19, provided the barrel 12 is impervious to moisture and the atmosphere. A non-stick polymeric seal 26 secured to the forward face of the plunger 20 can be a molded, resilient or semi-rigid, non-stick, elastomeric material such as a polyolefin, a polyurethane elastomer, a silicone elastomer, a vulcanized synthetic rubber, or the like. Other suitable materials include any of the non-stick fluorocarbon or chlorofluorocarbon polymers such as polytetrafluoroethylene, polychlorotrifluoroethylene, fluorinated ethylene-propylene polymers, polyvinylidene fluoride, polyhexafluoro-propylene, and the like, wherein the term "non-stick" refers to the property whereby the polymeric seal will not bond with adhesive 28 should it come in contact therewith. A particularly desirable elastomeric seal 26 comprises a molded composition such as a polymeric blend of polypropylene and crosslinked EPDM (that is, a polymer made from ethylene, propylene, and diene monomers wherein the diene exists in small amounts such as up to about 5 percent by weight of a monomer such as ethylene norborene, cyclopentadiene, hexadiene, and the like) known by the trade name Santoprene. The polymeric seal 26 ordinarily does not come in direct contact with the adhesive 28 due to the intervening hydrocarbon grease layer interfacing between the polymeric seal 26 and the adhesive 28. However, a seal 26 formed of Santoprene will not bond with adhesive 28 should it come in contact with trace amounts of the adhesive remaining on interior surface 19 of barrel 12 as the plunger 20 is moved forward.

Figure 2:
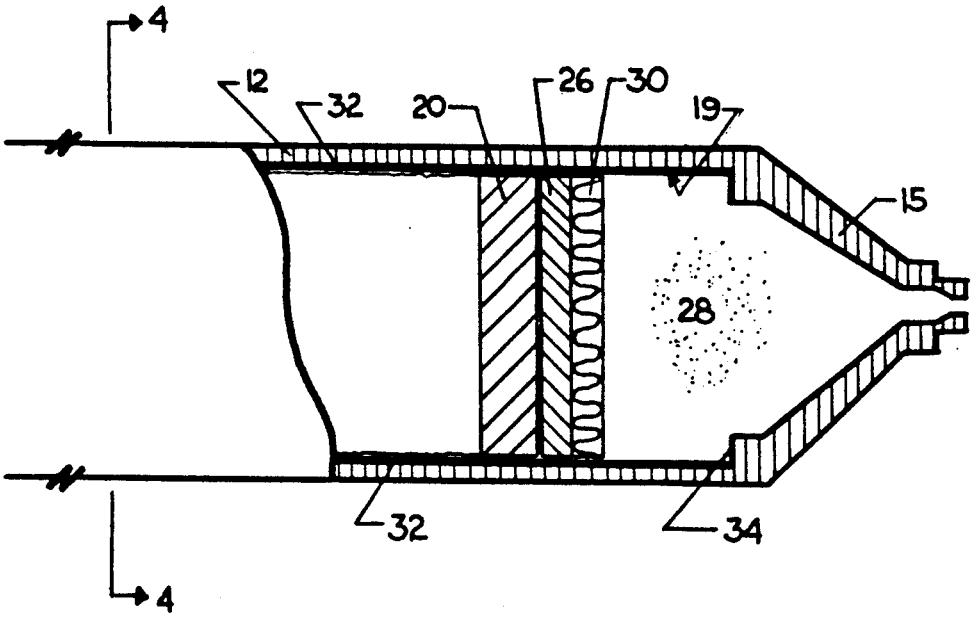
FIG. 2 is a front elevation view similar to FIG. 1, but in partial section and with the plunger of the syringe shown to be partially advanced forward.

In accordance with the present invention, a layer of non-reactive, essentially inert, hydrocarbon grease 30 is interposed between the forward face of the polymeric seal 26 and the adhesive 28 to provide a barrier layer between the seal 26 and the highly reactive, moisture-sensitive adhesive 28. The grease layer 30 is non-reactive relative to the adhesive 28 and further functions as a lubricating substance for the advancing plunger 20 as well as forming a thin film 32 rear seal for the radially outward sides of the plunger 20. As viewed in FIGS. 2 and 3, the thin film 32 of hydrocarbon grease 30 is deposited or coated on the entire interior surface 19 of the cylindrical barrel 12 as the plunger 20 advances forwardly toward the nozzle section 15 of the syringe 10. The hydrocarbon grease layer 30 flows radially outward to the interior surfaces 19 due to applied pressure generated between the advancing plunger 20 and the viscous adhesive 28.

The hydrocarbon grease 30 can generally be any grease which forms an effective moisture barrier or moisture-resistant layer. Generally, suitable materials have lubricating properties, high molecular weight, low water vapor transmission, high purity, neutral pH of from about 6.5 to about 7.5, and sufficient viscosity to maintain their integrity within the syringe barrel without diffusing through the adhesive or sealant, yet having a low enough viscosity to flow under pressure applied by plunger 20. Such properties encompass several classes of materials, including lubricating greases, saturated vegetable oils, low melting paraffin waxes having a melting point of from about 120 to about 140° F. A particularly desirable class of materials are petrolatum products. These materials are highly refined pure materials which have no effect on the stability of reactive adhesives. They typically are supplied in various grades with melting points from 118°-140° F., and cone penetration consistencies of 100 to 300, as measured by ASTM D937. Typical examples are materials identified by the trade names "Snow White Petrolatum" and "Super Petrolatum" and sold by Penreco Corp.

Figure 3:
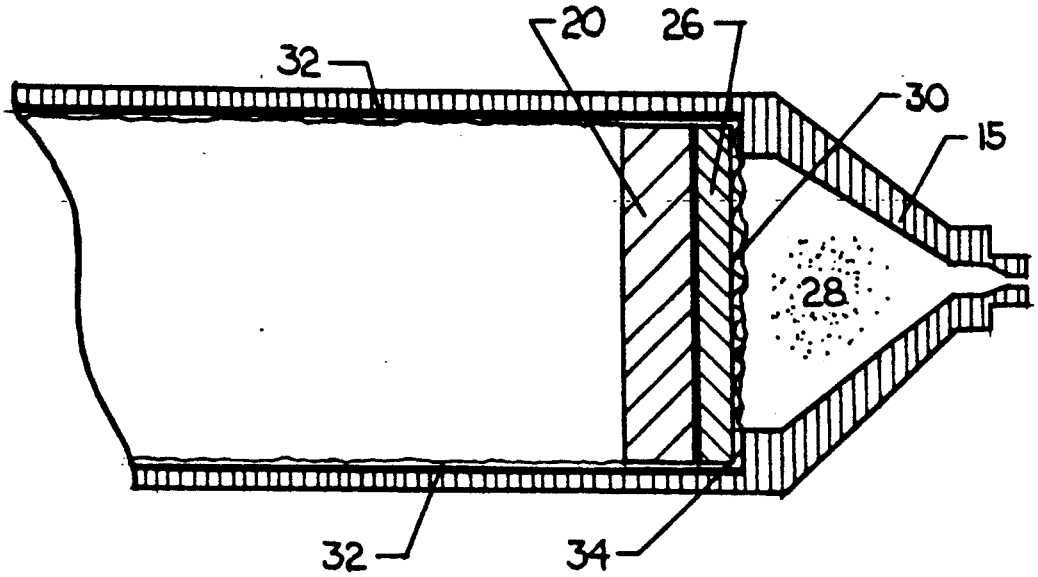
FIG. 3 is a sectional view similar to FIG. 1, but with the plunger advanced fully forward to the nozzle section of the syringe barrel.
Figure 4:
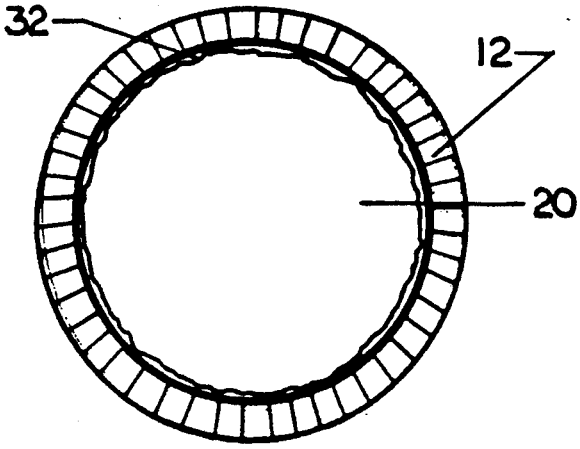
FIG. 4 is a sectional view taken along line 4—4 in FIG. 2.

The interior of the syringe 10 contains a forward stop means comprising a peripheral stop 34 secured to or integral with the internal wall surface 19 axially adjacent to the narrowed nose section 15. The shoulder stop 34 functions as a stop means for the advancing plunger 20 and is laterally spaced from the dispensing nozzle 16 to assure that remaining grease 30 is not discharged from the syringe 10 but is retained within the nozzle section 15. As shown in FIG. 3, unused grease 30 and small amounts of adhesive 28 are retained within the nose section 15 when the plunger 20 is fully advanced and the adhesive syringe is spent. Thus, the grease layer 30 provides a flowable barrier layer under pressure to form a thin film 32 lubricant and sealing barrier on the interior surface 19 of the cylindrical barrel 12 to prevent inoperative bonding with the outer periphery of the polymeric seal 26 and further provides a moisture seal on the rear side of the advancing plunger 20. The dispensing nozzle 16 is fitted with an air-tight sealing cap 18 to secure the nozzle 16 from moisture or other atmospheric contaminants contacting the adhesive 28 contents while the syringe 10 is not in use.

The adhesive-dispensing syringe 10 of the present invention is particularly useful for dispensing highly reactive, moisture-sensitive cyanoacrylate adhesives. Cyanoacrylic adhesives are based on cyanoacrylic ester monomers typically prepared from methyl 2-cyanoacrylate and ethyl 2-cyanoacrylate. Other moisture-sensitive or moisture-cure adhesives include, for example, isocyanate polymers typically comprising the reaction product of polyether polyol and excess equivalents of aromatic diisocyanate which reacts with moisture to produce polyurethane urea bonds; silicone adhesives comprising blocked hydroxyl functional compounds rendered moisture curable in the presence of hydrolyzable silyl compounds such as acetates, oximes, esters and amines; polysulfide sealants compounded with calcium or barium peroxide activated by moisture to cure the polysulfide; unsaturated polyester polymers containing barium peroxide and cobalt salt activated by moisture to initiate crosslinking; and epoxy resin adhesives compounded with ketimines and activated by moisture to generate amine curing agents.

In accordance with the invention, the syringe 10 is fitted with a cap 18 and can be filled with moisture-sensitive adhesive 28 from the rearward opening of the barrel 12. Thereafter, a layer of hydrocarbon grease 30 is inserted into the syringe and located on the exposed rear surface of the adhesive in the presence of a dry atmosphere such as nitrogen. To facilitate insertion of the hydrocarbon grease layer, the hydrocarbon grease can be heated moderately to provide a flowable or fluid grease which can be poured or discharged under moderate pressure to provide the hydrocarbon grease layer 30. The plunger 20 containing the polymeric seal 26 is then fitted into the cylindrical barrel 12.

In operation, the cap 18 is removed and the plunger 20 is advanced forwardly within the cylindrical barrel 12 to discharge adhesive 28 from the dispensing nozzle 16. As the plunger 20 advances forwardly, the hydrocarbon grease layer 30 is subjected to axial squeezing between the advancing plunger 20 and the resistant adhesive 28, thereby causing the hydrocarbon grease layer 30 to be subjected to radially outward pressure, whereby the grease layer 30 deposits a thin film 32 of grease on the interior surface of the cylindrical barrel 12 as the plunger 20 advances forwardly. The thin film 32 is formed by the polymeric seal 26 slidably engaging the interior surface 19 whereby a trailing thin film 32 forms behind the plunger 20 and thereby provides an air-tight, moisture-impervious thin film 32 protecting the adhesive 28.

The present invention will be better understood by reference to the following examples:

EXAMPLES

Syringes of b 15-cc capacity were prepared using HDPE (High Density Polyethylene) cylindrical barrels having an internal diameter of 17 mm and a wall thickness of 1.5 mm, and filled with 10 cc's of a low viscosity ethyl cyanoacrylate adhesive such as one identified by the trade name Loctite 420, manufactured by Loctite Corp. The syringes were tested for functionality by advancing the plunger and dispensing a few drops of adhesive.

EXAMPLE 1 (CONTROL)

The syringes of Example 1 were fitted with HDPE plungers and it was found that within less than 15 minutes after filling with adhesive, the plungers could not be advanced forward without sticking and having a severe jerking action. After being left for 8 hours the plungers could not be advanced, showing adhesion between the plunger and the barrel. The syringe was totally non-functional.

EXAMPLE 2 (CONTROL)

The syringes of Example 1 were fitted with silicone rubber plungers in the form of grommets formed over an HDPE insert. Somewhat better performance was observed, but within 8 hours partial curing of the adhesive with subsequent adhesion between the plunger and barrel wall was noted. On disassembly of the syringe, the silicone was found to have been swelled excessively by contact with the adhesive. This example shows that the plunger is not compatible with the adhesive.

EXAMPLE 3

2 cc's of "Super Petrolatum" manufactured by Penreco Corp. were melted, poured on top of the cyanoacrylate and allowed to solidify by cooling. The syringes were fitted with HDPE plungers. Performance was satisfactory for 24–48 hours whereupon the syringes were non-functional indicating that the petrolatum did not completely prevent adhesion between the plunger and the barrel.

EXAMPLE 4

The syringes were fitted with Santoprene rubber plungers in the form of grommets formed over an HDPE insert. Prior to insertion into the barrel the plungers were lubricated with a thin coating of Super Petrolatum. After 7 to 14 days the syringes showed signs of adhesion and poor dispensibility indicating some moisture permeation into the adhesive.

EXAMPLE 5

2 cc's of the "Super Petrolatum" were melted, poured on top of the cyanoacrylate and allowed to solidify by cooling. The syringes were fitted with Santoprene rubber plungers in the form of grommets formed over an HDPE insert. After 38 days of use, the syringes were still functional, showing no signs of adhesion or curing of the adhesive. Syringes left for 7 months at room temperature prior to use were still completely functional with no evidence of adhesion or curing of the adhesive.

This example shows that a combination of a plunger with low frictional properties, which is compatible with the adhesive and is difficult to adhere to, plus a barrier layer of a grease which both lubricates and provides a moisture barrier, produces a syringe which is functional for a practical period of time.

EXAMPLE 6

Example 5 was repeated using another low viscosity ethyl cyanoacrylate, Aravite C11, manufactured by Ciba-Geigy Corporation, and with a thick paste adhesive, Quick Gel Super Glue, manufactured by Loctite Corporation. Syringes which were functional after 6 months storage at room temperature were found in both cases.

While in accordance with the Patent Statutes, the best mode and preferred embodiments have been set forth, the scope of the invention is not intended to be limited thereto, but only by the scope of the attached claims.

What is claimed is:

1. A syringe for containing and dispensing a reactive material, said syringe comprising:

a container having an interior cylindrical surface defining a cylindrical barrel having a rear end and a forward end, and further having a nozzle section terminating in a dispensing nozzle secured to the forward end of the cylindrical barrel;

a plunger disposed within the cylindrical barrel for advancing forwardly within said barrel to dispense reactive material from the dispensing nozzle, said plunger having a forward surface comprising a non-stick polymeric seal adapted to slidably engage the interior surface of the cylindrical barrel; and a layer of hydrocarbon grease disposed intermediate and adjacent to the forward surface of the polymeric seal and the rearward surface of the reactive material contained in the cylindrical barrel, whereby said layer of grease lubricates the interior surface of the cylindrical barrel with a thin film of the grease as the plunger advances forwardly therein for enhanced slidable forward movement of said plunger within said barrel.

2. The syringe defined in claim 1, wherein the reactive material is a cyanoacrylate adhesive.

3. The syringe defined in claim 1, wherein said non-stick polymeric seal is a polyolefin, a silicone elastomer, a polyurethane elastomer, a vulcanized synthetic rubber, a fluorocarbon polymer, or a chlorofluorocarbon polymer.

4. The syringe defined in claim 3, wherein the polymeric seal is a non-stick blend of polypropylene and crosslinked EPDM.

5. The syringe defined in claim 1, wherein the container contains an interior stop means for stopping the forward advancement of the polunger within the cylindrical barrel.

6. The syringe defined in claim 5, wherein the stop means is located approximate to the nozzle section and comprises a peripheral shoulder located in the cylindrical barrel adjacent to the nozzle section.

7. The syringe defined in claim 1, wherein the thin film of hydrocarbon grease deposited on the interior surface of the cylindrical barrel forms a moisture-impervious seal between the polymeric seal and said interior surface for sealing the reactive material contained in said barrel from the atmosphere; and in which a removable cap fitted on the dispensing nozzle further seals said reactive material from said atmosphere.

8. The syringe defined in claim 7, wherein said non-stick polymeric seal is a polyolefin, a silicon elastomer, a polyurethane elastomer, a vulcanized synthetic rubber, a fluorocarbon polymer, or a chlorofluorocarbon polymer.

9. The syringe defined in claim 8, wherein the polymeric seal is a non-stick blend of polypropylene and crosslinked EPDM.

10. The syringe defined in claim 7, wherein the layer of hydrocarbon grease is a lubricating grease, a saturated vegetable oil, or a paraffin wax.

11. The syringe defined in claim 10, wherein said non-stick polymeric seal is a polyolefin, a silicone elastomer, a polyurethane elastomer, a vulcanized synthetic rubber, a fluorocarbon polymer, or a chlorofluorocarbon polymer.

12. The syringe defined in claim 11, wherein the polymeric seal is a non-stick blend of polypropylene and crosslinked EPDM.

13. The syringe defined in claim 10, wherein the hydrocarbon grease layer is petrolatum.

14. The syringe defined in claim 13, wherein said non-stick polymeric seal is a polyolefin, a silicone elastomer, a polyurethane elastomer, a vulcanized synthetic rubber, a fluorocarbon polymer, or a chlorofluorocarbon polymer.

15. The syringe defined in claim 14, wherein the polymeric seal is a non-stick blend of polypropylene and crosslinked EPDM.

16. The syringe defined in claim 15, wherein the container contains an interior stop means for stopping the forward advancement of the plunger within the cylindrical barrel.

17. The syringe defined in claim 16, wherein the stop means is located approximate to the nozzle section and comprises a peripheral shoulder located in the cylindrical barrel adjacent to the nozzle section.

18. The syringe of claim 17, wherein the reactive material is a cyanoacrylate adhesive.

19. A method of producing a syringe for containing and dispensing a reactive material, said method comprising the steps of:

providing a syringe having an interior cylindrical surface defining a cylindrical barrel, said cylindrical barrel fitted with a plunger operative to advance forwardly within the barrel to dispense the reactive material contained therein, and with the plunger forward face comprising a non-stick polymeric seal which slidably engages the interior surface of the cylindrical barrel; and providing a layer of hydrocarbon grease intermediate and adjacent to the forward surface of the polymeric seal and the rearward surface of the reactive material contained in the barrel, whereby said layer of grease lubricates the interior surface of the cylindrical barrel with a thin film of the grease as the plunger advances forwardly therein for enhanced slidable forward movement of said plunger within said barrel, and further forms a moisture-impervious seal between the polymeric seal and said interior surface for sealing the reactive material contained in said barrel from the atmosphere.

* * * * *